US010661279B2

(12) United States Patent
Demsia

(10) Patent No.: US 10,661,279 B2
(45) Date of Patent: May 26, 2020

(54) LABORATORY PIPETTE STAND

(71) Applicant: MTC Bio, Inc., Sayreville, NJ (US)

(72) Inventor: Walter Demsia, Holmdel, NJ (US)

(73) Assignee: MTC BIO, INC., Sayreville, NJ (US)

( * ) Notice: Subject to any disclaimer, the term of this patent is extended or adjusted under 35 U.S.C. 154(b) by 238 days.

(21) Appl. No.: 15/943,863

(22) Filed: Apr. 3, 2018

(65) Prior Publication Data

US 2019/0299216 A1 Oct. 3, 2019

(51) Int. Cl.
*B01L 9/00* (2006.01)
*B01L 3/02* (2006.01)

(52) U.S. Cl.
CPC ..... *B01L 9/54* (2013.01); *B01L 3/0217* (2013.01); *B01L 2200/023* (2013.01); *B01L 2200/025* (2013.01)

(58) Field of Classification Search
None
See application file for complete search history.

(56) References Cited

U.S. PATENT DOCUMENTS 1,761,088 A * 6/1930 Pryde ..... A47F 5/04 211/68
4,095,697 A * 6/1978 Matthaei ..... B01L 9/00 211/134
4,688,685 A * 8/1987 Brace ..... A63C 11/028 211/60.1
5,961,927 A * 10/1999 Isaacs ..... B01L 9/54 211/60.1
8,636,259 B2 * 1/2014 Manke ..... G01N 30/6047 211/78
10,549,026 B2 * 2/2020 Endyk ..... A61M 5/008
(Continued)

OTHER PUBLICATIONS

Daigger Scientific, "Sharkfin Pipette Tip Rack Stand, Pipette Stand, & Double Bin", captured Feb. 10, 2018, http://web.archive.org/web/20180210022519/https://www.daigger.com/sharkfin-pipette-tip-rack-stand-pipette-stand-double-bin-i-heahs20650a (Year: 2018 ).*
(Continued)

*Primary Examiner* — Jill A Warden
*Assistant Examiner* — Brittany I Fisher
(74) *Attorney, Agent, or Firm* — Fox Rothschild LLP

(57) ABSTRACT

A laboratory pipette stand for use with single channel and multi-channel pipettes in a laboratory environment is disclosed. The laboratory stand includes a unitary structure having an angular longitudinal planar body and a supporting base portion. A first tier of a plurality of outwardly projecting pronged sections having a plurality of concave sections therebetween is formed at an upper portion of the unitary structure. A second tier of a plurality of outwardly projecting pronged sections having a plurality of concave sections therebetween is formed at a middle portion of the unitary structure. The first and second tiers are configured for holding a plurality of single channel and multi-channel laboratory pipettes thereto. At least one elongated opening is formed in the angular longitudinal planar body from the middle portion to a lower portion of the unitary structure such that the at least one elongated opening is configured for receiving a manifold of the multi-channel laboratory pipette therethrough.

14 Claims, 6 Drawing Sheets

(56) References Cited

U.S. PATENT DOCUMENTS

| | | | | |
|---|---|---|---|---|
| 2011/0209564 | A1* | 9/2011 | Von Beichmann | B01L 9/00 73/864.01 |
| 2014/0004020 | A1* | 1/2014 | Tubbs | B01L 9/54 422/509 |
| 2015/0216301 | A1* | 8/2015 | Yates | A47B 81/005 211/70.8 |
| 2016/0082437 | A1* | 3/2016 | Perroud | B01L 3/502792 204/453 |
| 2017/0193712 | A1* | 7/2017 | Keller | G07C 1/08 |
| 2018/0029040 | A1* | 2/2018 | Driscoll | B01L 9/54 |

OTHER PUBLICATIONS

VWR, "VWR Plasticware," 2013, https://us.vwr.com/assetsvc/asset/en_US/id/17617706/contents/vwr_plasticware_931443w.pdf ( Year: 2013).*

Heathrow Scientific® "Acrylic and ABS Pipette Stands" printed on Apr. 3, 2018, available at http://www.heathrowscientific.com/acrylic-and-abs-pipette-stands-i-hea206203-group?_vsrefdom=adwords&gclid=Cj0KCQjwqYfWBRDPARIsABjQRYwEuUIFW5n9v6KS9gMTL01yhXkajMsoalENERT_X8ZmT8MfKzCE4PMaArn8EALw_wcB.

Yahoo.com Image search for "pipette stand", printed on Apr. 3, 2018, available at https://images.search.yahoo.com/search/images;_ylt=AwrE189hpMJaHKUAxC5XNyoA;_ylu=X3oDMTB0N2Noc21IBGNvbG8DYmYxBHBvcwMxBHZ0aWQDBHNIYwNwaXZz?p=pipette+stand&fr2=piv-web&fr=yfp-t#id=0&iurl=http%3A%2F%2Flabrepco.com%2Fdata%2Fcatalog%2Fproducts%2F1847%2Fmain%2F6-Place%2520Pipettor%2520Stand.png&action=click.

Yahoo.com image search for "pipette stand" printed on Apr. 3, 2018, availalbe at https://images.search.yahoo.com/search/images;_ylt=AwrE189hpMJaHKUAxC5XNyoA;_ylu=X3oDMTB0N2Noc21IBGNvbG8DYmYxBHBvcwMxBHZ0aWQDBHNIYwNwaXZz?p=pipette+stand&fr2=piv-web&fr=yfp-t#id=0&iurl=http%3A%2F%2Flabrepco.com%2Fdata%2Fcatalog%2Fproducts%2F1847%2Fmain%2F6-Place%2520Pipettor%2520Stand.png&action=close.

Yahoo.com Image search for "pipette stand", printed on Apr. 3, 2018, available at https://images.search.yahoo.com/search/images;_ylt=AwrE189hpMJaHKUAxC5XNyoA;_ylu=X3oDMTB0N2Noc21IBGNvbG8DYmYxBHBvcwMxBHZ0aWQDBHNIYwNwaXZz?p=pipette+stand&fr2=piv-web&fr=yfp-t#id=190&iurl=http%3A%2F%2Fblog.universalmedicalinc.com%2Fwp-content%2Fuploads%2Fsites%2F136%2Fgallery%2Fpostimages%2F6-Place-Blue-ABS-Pipette-Stand.jpg&action=click.

* cited by examiner

LABORATORY PIPETTE STAND

TECHNICAL FIELD

The present disclosure relates to the field of laboratory products for scientific research, and more particularly, to a laboratory pipette stand for holding single channel and multi-channel pipettes in a laboratory environment.

BACKGROUND

Conventional laboratory pipette stands used in the laboratory environment have many disadvantages. In particular, conventional pipette stands are typically limited to holding single channel pipettes and are not designed to accommodate the manifolds of multi-channel pipettes along with single channel pipettes. Further, conventional pipette stands are not able to accommodate all types and brands of laboratory pipettes used in the laboratory environment.

It would thus be desirable to have an improved pipette stand for use with various laboratory pipette products, among other desirable features as described herein, which avoids the disadvantages of conventional pipette stands used in the laboratory.

SUMMARY

In a first aspect, there is provided herein a laboratory pipette including a unitary structure having an angular longitudinal planar body and a supporting base portion. A first tier of a plurality of outwardly projecting pronged sections having a plurality of concave sections therebetween is formed at an upper portion of the unitary structure. A second tier of a plurality of outwardly projecting pronged sections having a plurality of concave sections therebetween is formed at a middle portion of the unitary structure such that the first and second tiers are configured for holding a plurality of single channel and multi-channel laboratory pipettes thereto. At least one elongated opening is formed in the angular longitudinal planar body from the middle portion to a lower portion of the unitary structure such that the at least one elongated opening is configured for receiving a manifold of the multi-channel laboratory pipette therethrough.

In certain embodiments, the unitary structure is a zigzag shape.

In certain embodiments, the plurality of concave sections of the first and second tiers are U-shaped channels.

In certain embodiments, the at least one elongated opening gradually tapers inward from a proximal end to a distal end thereof.

In certain embodiments, the at least one elongated opening is sized and shaped for receiving the manifold of the multi-channel laboratory pipette therethrough.

In certain embodiments, the plurality of concave sections of the first and second tiers form a plurality of pipette positions in which the single channel and multi-channel pipettes are secured therein.

In certain embodiments, the at least one elongated opening is positioned thereunder each pipette position along the angular longitudinal planar body of the unitary structure.

In certain embodiments, the at least one elongated opening is positioned thereunder the plurality of pipette positions thereacross the angular longitudinal planar body of the unitary structure.

In certain embodiments, the laboratory pipette stand is fabricated of at least one of plastic, acrylonitrile butadiene styrene (ABS), acrylic, polypropylene, polycarbonate, polystyrene, thermoplastic polymers, sheet metal, aluminum, and stainless steel.

In certain embodiments, the laboratory pipette stand is manufactured via machine cutting, thermoforming, sonic welding and gluing.

In a second aspect, there is provided herein a laboratory pipette stand including a unitary structure having an angular longitudinal planar body and a supporting base portion. A first tier of a plurality of outwardly projecting pronged sections having a plurality of concave sections therebetween are formed at an upper portion of the unitary structure. A second tier of a plurality of outwardly projecting pronged sections having a plurality of concave sections therebetween are formed at a middle portion of the unitary structure such that the first and second tiers are configured for holding a plurality of single channel and multi-channel laboratory pipettes thereto. A series of elongated openings are formed in the angular longitudinal planar body from the middle portion to a lower portion of the unitary structure such that the series of elongated openings are configured for receiving manifolds of a plurality of multi-channel laboratory pipettes therethrough.

In certain embodiments, the series of elongated openings include two or four openings formed therein the angular longitudinal planar body of the unitary structure.

In certain embodiments, the series of elongated openings gradually taper inward from a proximal end to a distal end thereof.

In certain embodiments, the series of elongated openings are sized and shaped for receiving the manifolds of the plurality of multi-channel laboratory pipettes therethrough.

Various advantages of this disclosure will become apparent to those skilled in the art from the following detailed description, when read in light of the accompanying drawings.

DETAILED DESCRIPTION

Figure 1:
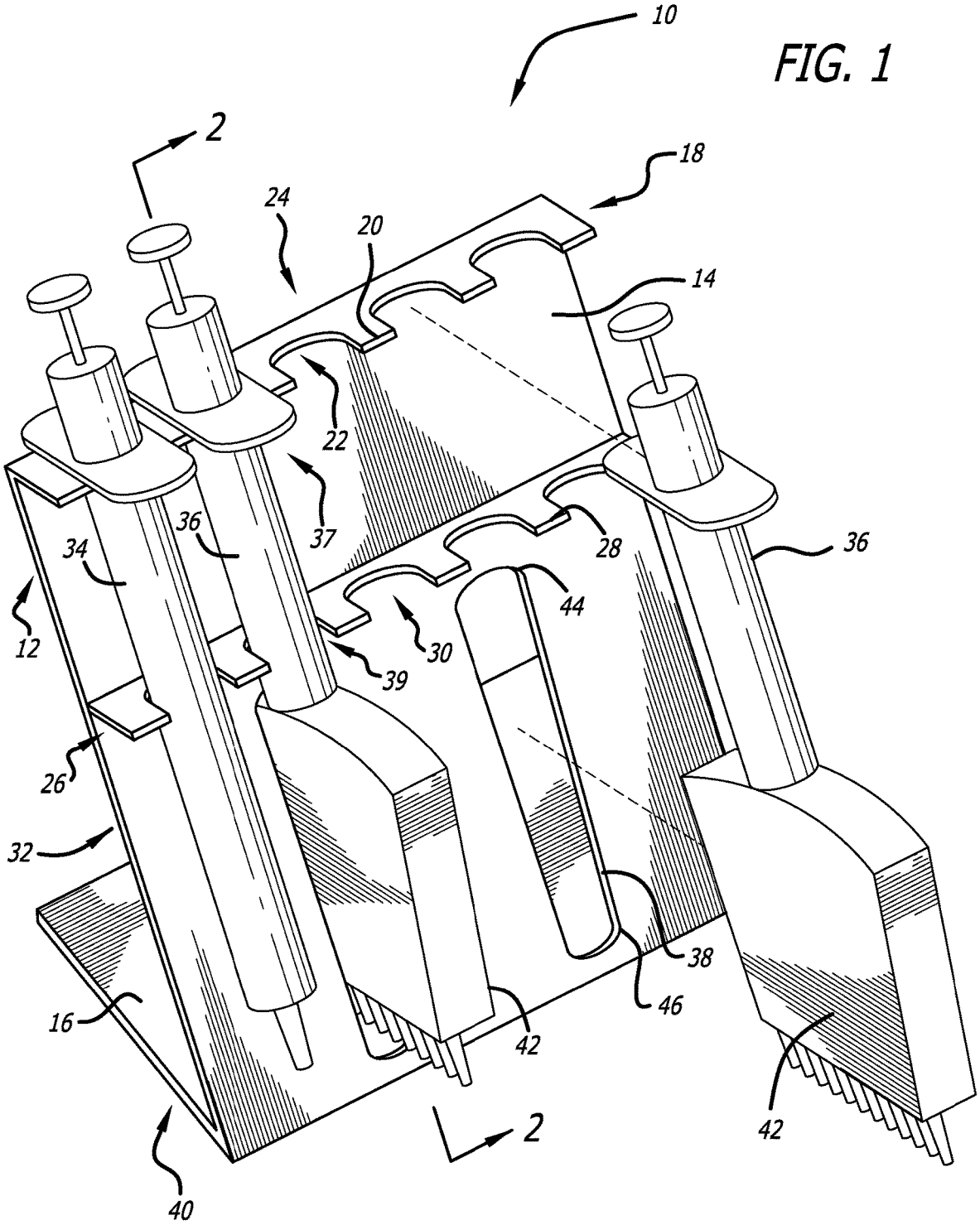
FIG. 1 is a left, front, top perspective view of the laboratory pipette stand shown with a single channel pipette held therein and a multi-channel pipette with manifold received therein an elongated opening adjacent to another elongated opening in accordance with an example embodiment of the present disclosure.
Figure 2:
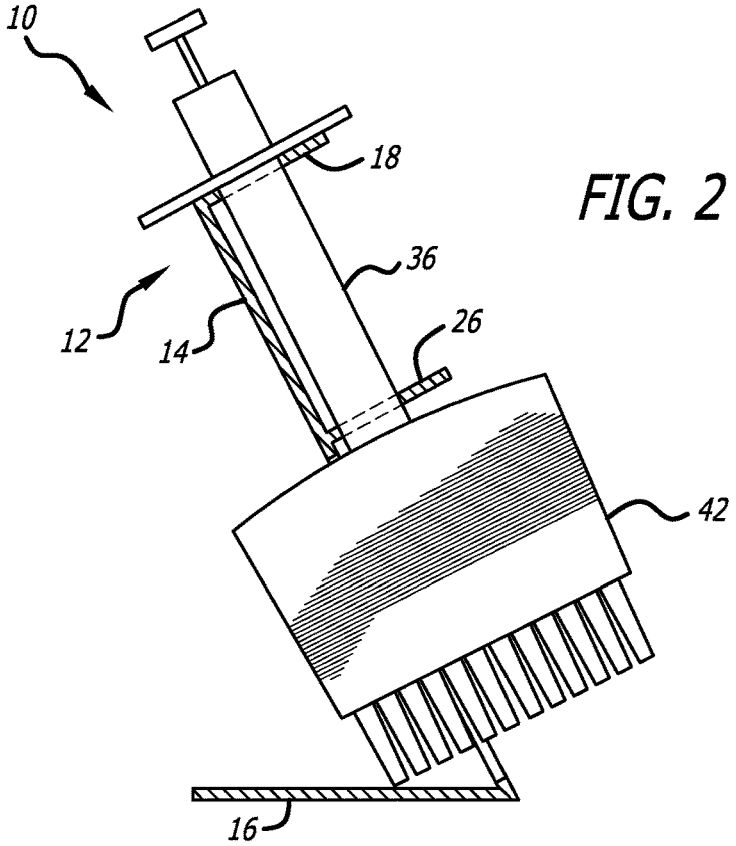
FIG. 2 is a cross-section view along the line 2-2 in FIG. 1 showing the laboratory pipette stand with the multi-channel pipette and manifold received therein the elongated opening in accordance with an example embodiment of the present disclosure.
Figure 3:
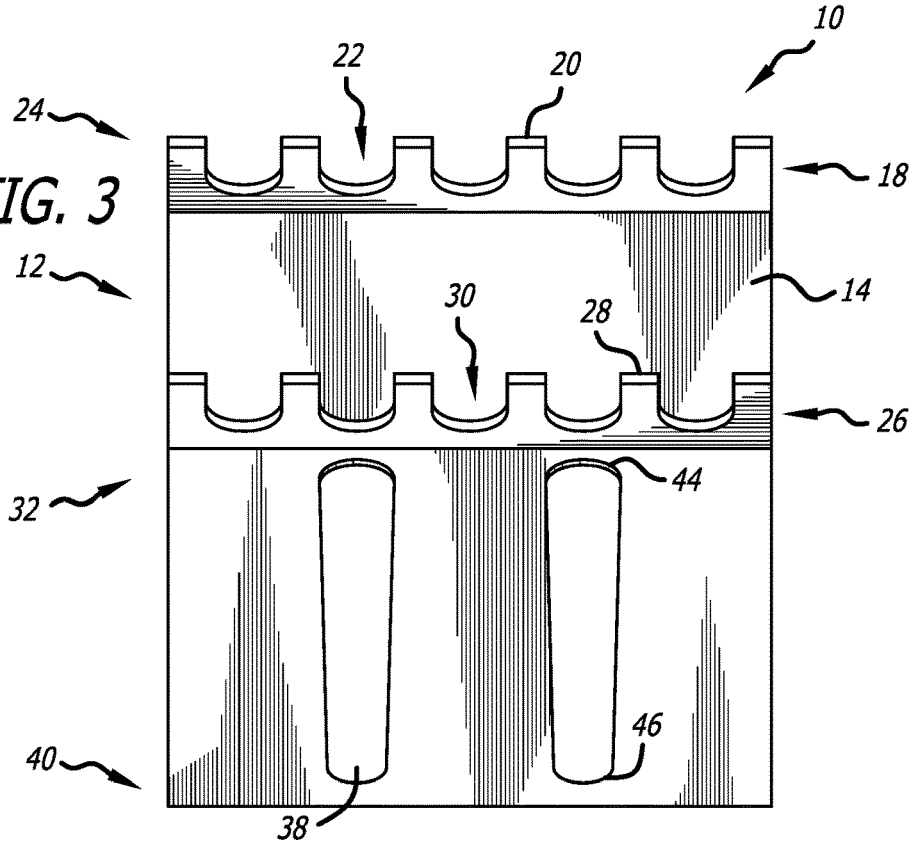
FIG. 3 is a front elevation view of the laboratory pipette stand of FIG. 1 in accordance with an example embodiment of the present disclosure.
Figure 4:
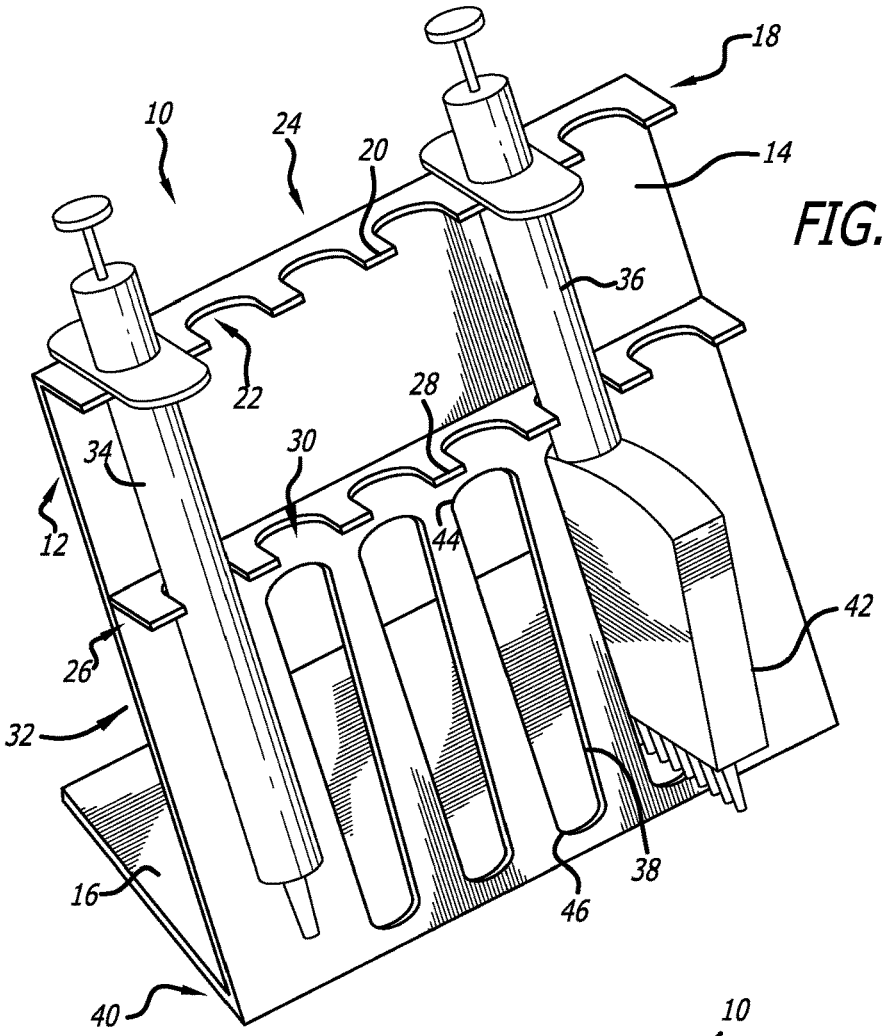
FIG. 4 is a left, front, top perspective view of the laboratory pipette stand shown with a single channel pipette held therein and a multi-channel pipette with manifold received therein an elongated opening adjacent a series of elongated openings in accordance with an example embodiment of the present disclosure.
Figure 5:
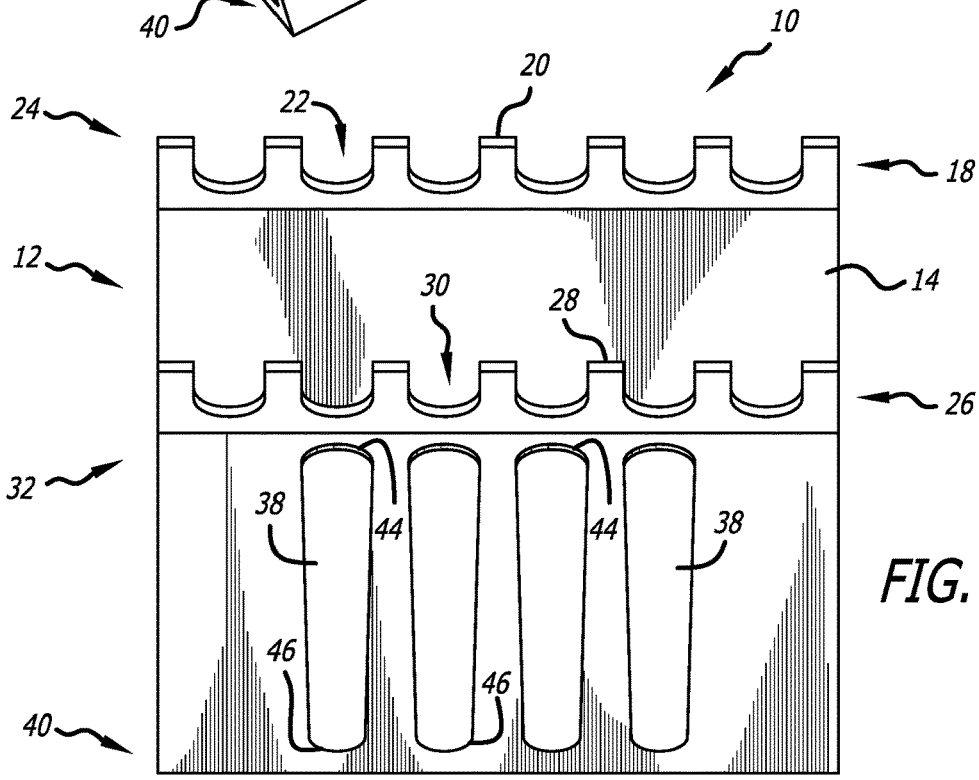
FIG. 5 is a front elevation view of the laboratory pipette stand of FIG. 4 in accordance with an example embodiment of the present disclosure.
Figure 6:
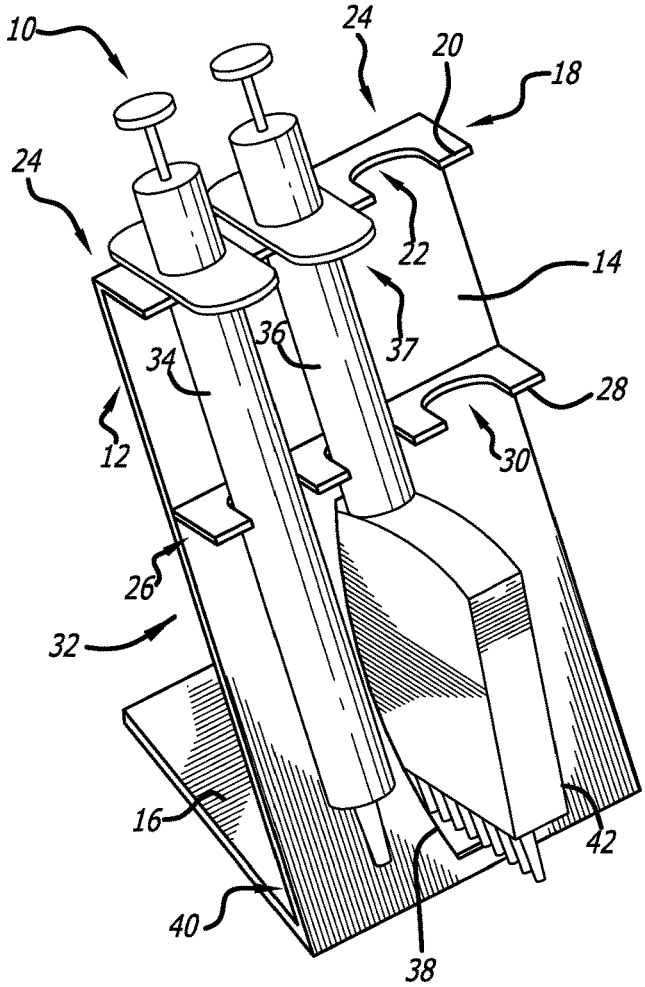
FIG. 6 is a left, front, top perspective view of the laboratory pipette stand shown with a single channel pipette held therein and a multi-channel pipette with manifold received therein a different shaped elongated opening with no further elongated openings in accordance with an example embodiment of the present disclosure.
Figure 7:
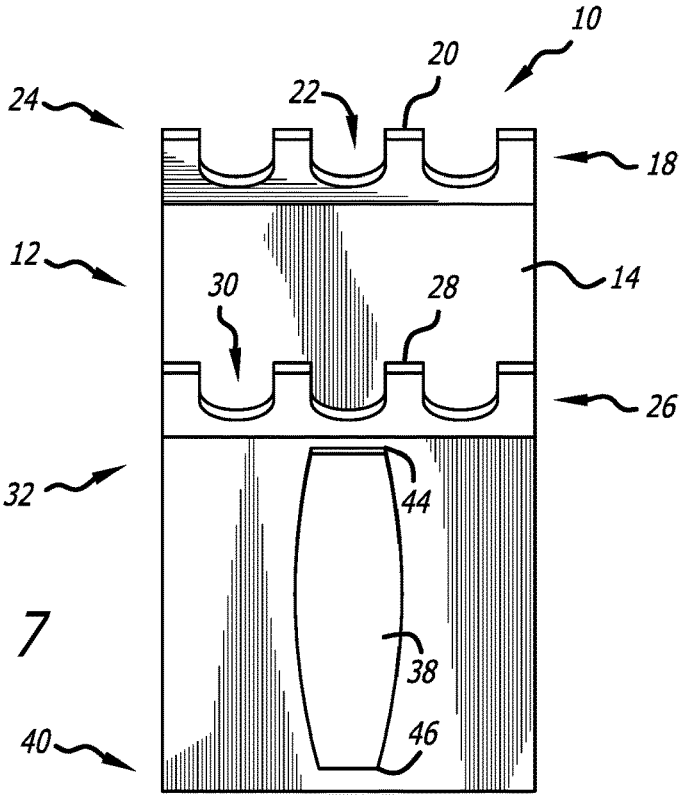
FIG. 7 is a front elevation view of the laboratory pipette stand of FIG. 6 in accordance with an example embodiment of the present disclosure.

This disclosure is not limited to the particular apparatus, systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All sizes recited in this document are by way of example only, and the disclosure is not limited to structures having the specific sizes or dimensions recited below. As used herein, the term "comprising" means "including, but not limited to."

In consideration of the figures, it is to be understood for purposes of clarity that certain details of construction and/or operation are not provided in view of such details being conventional and well within the skill of the art upon disclosure of the document described herein.

The present disclosure pertains to a laboratory pipette stand having one or more openings for use with both single channel and multi-channel pipettes in a laboratory environment. The laboratory pipette stand can hold nearly all brands and types of handheld pipettes in accordance with the present disclosure. Extra thickness is used throughout the entire unitary structure to reinforce and replace the strength that is taken away when one or more elongated openings are cut out of the angular support surface. The laboratory pipette stand of the present disclosure is angled to allow gravity to hold the pipettes in place and at two points of contact. It is the combination of gravity and the one or more openings formed therein the laboratory pipette stand that allow multi-channel pipettes and various brands of pipettes to rest securely thereon.

Referring now to FIGS. 1-7, the laboratory pipette stand 10 will be described in more detail in accordance with the present disclosure. The laboratory pipette stand 10 generally includes a unitary structure 12 having an angular longitudinal planar body 14 and a supporting base 16 portion. A first tier 18 of a plurality of outwardly projecting pronged sections 20 having a plurality of concave sections 22 therebetween is formed at an upper portion 24 of the unitary structure 12. A second tier 26 of a plurality of outwardly projecting pronged sections 28 having a plurality of concave sections 30 therebetween is formed at a middle portion 32 of the unitary structure 12. The first and second tiers 18, 26 are configured for holding a plurality of single channel and multi-channel laboratory pipettes 34, 36 thereto. The plurality of concave sections 22, 30 of the first and second tiers 18, 26 form a plurality of pipette positions 37, 39 for holding the single channel and multi-channel laboratory pipettes 34, 36. At least one elongated opening 38 is formed in the angular longitudinal planar body 14 from the middle portion 32 to a lower portion 40 of the unitary structure 12 such that the at least one elongated opening 38 is configured for receiving a manifold 42 of the multi-channel laboratory pipette 36 therethrough.

In the illustrated embodiments, the unitary structure 20 is a zigzag shape.

In some embodiments, the plurality of concave sections 22, 30 of the first and second tiers 18, 26 are U-shaped channels. It is to be understood that the plurality of concave sections 22, 30 can form other suitable shapes sufficient to hold the single channel and multi-channel pipettes 34, 36 in the first and second tiers 18, 26 of the laboratory pipette stand 10.

It is presently contemplated that the laboratory pipette stand 10 can include one or more elongated openings 38 formed therein such that the laboratory pipette stand 10 is referred to as a single series (i.e., one elongated opening), double series (i.e., two elongated openings), triple series (i.e., three elongated openings), quadruple series (i.e., four elongated openings), and so forth. It is to be understood that the laboratory pipette stand 10 is not limited to the number of elongated openings 38 corresponding to the select pipette positions represented in the figures disclosed herein. Accordingly, the laboratory pipette stand 10 is not limited to any particular size or dimension and is suitably sized depending on the number of elongated openings 38 and pipette positions 37, 39 formed therein.

In other embodiments, the at least one elongated opening 38 gradually tapers inward from a proximal end 44 to a distal end 46 thereof. It is to be understood that the elongated opening 38 can form other suitable shapes (see FIGS. 6-7) sufficient to receive the manifold 42 of the multi-channel pipette 36 therethrough.

In further embodiments, the at least one elongated opening 38 is sized and shaped for receiving the manifold 42 of the multi-channel laboratory pipette 36 therethrough. It is to be understood that the at least one elongated opening 38 is suitably sized and shaped to receive the manifold 42 of the multi-channel pipette 36 therethrough and is not limited to any particular size, shape or dimension (see FIGS. 6-7).

Figure 8:
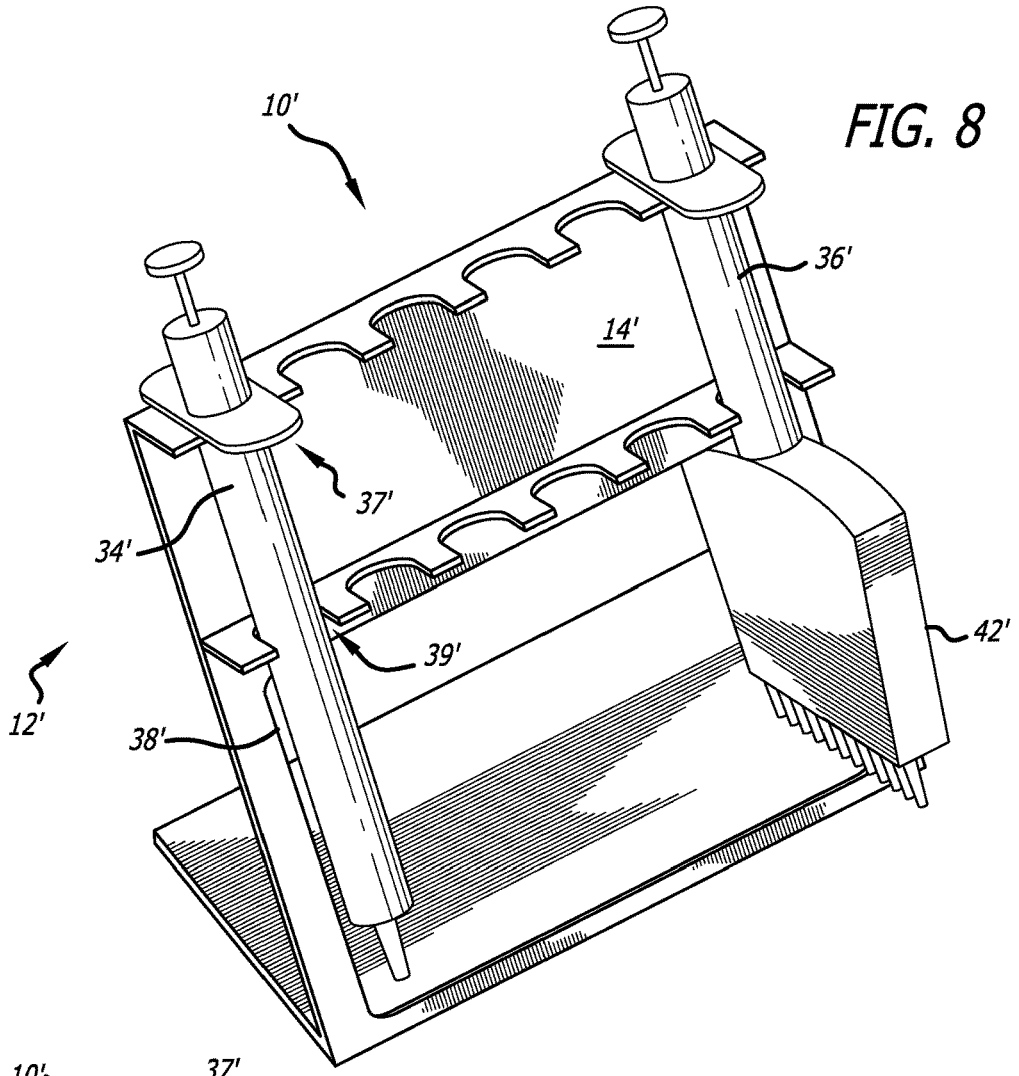
FIG. 8 is a left, front, top perspective view of another embodiment of the laboratory pipette stand shown with a single channel pipette held therein and a multi-channel pipette with manifold received therein a single elongated opening thereacross an angular longitudinal planar body of the laboratory pipette stand in accordance with the present disclosure.
Figure 9:
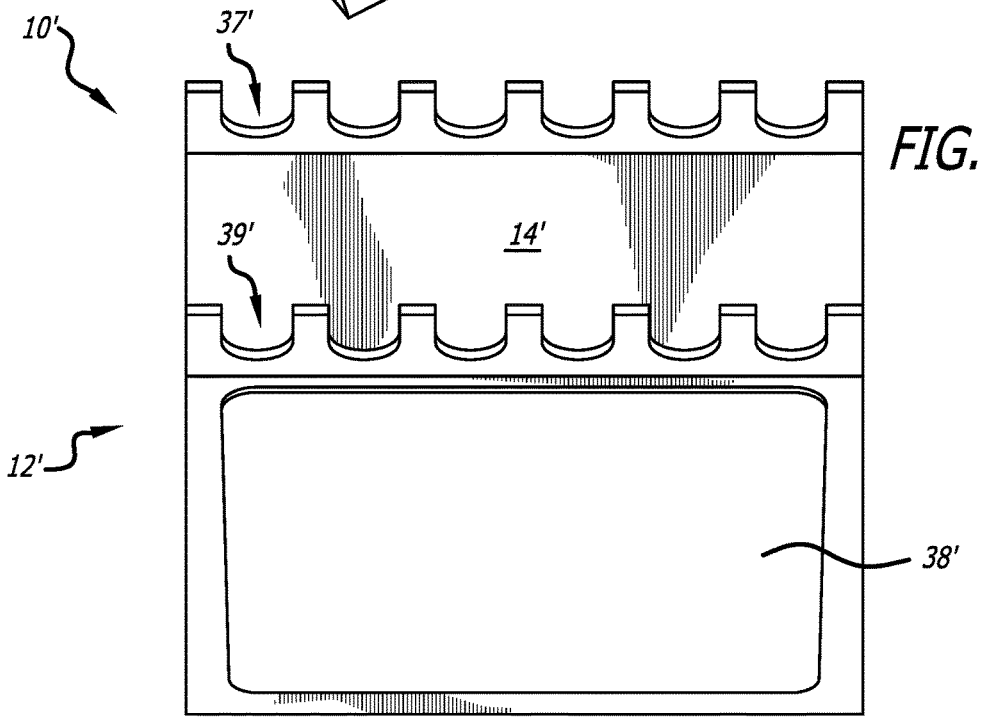
FIG. 9 is a front elevation view of the laboratory pipette stand of FIG. 8 in accordance with an example embodiment of the present disclosure.

Referring now to FIGS. 8-9, in the illustrated embodiments, the elongated opening 38' is positioned thereunder a plurality of pipette positions 37', 39' thereacross the angular longitudinal planar body 14' of the unitary structure 12' in accordance with the present disclosure. In this embodiment of the laboratory pipette stand 10', the elongated opening 38' is longitudinal as it spans nearly the entire length of the angular longitudinal planar body 14'. It is to be understood that the single channel and/or multi-channel pipettes 34',36' can be held in the laboratory pipette stand 10'. The laboratory pipette stand 10' is not limited to any particular size or dimension and is suitably sized depending on the number of pipette positions 37',39' formed therein.

Figure 10:
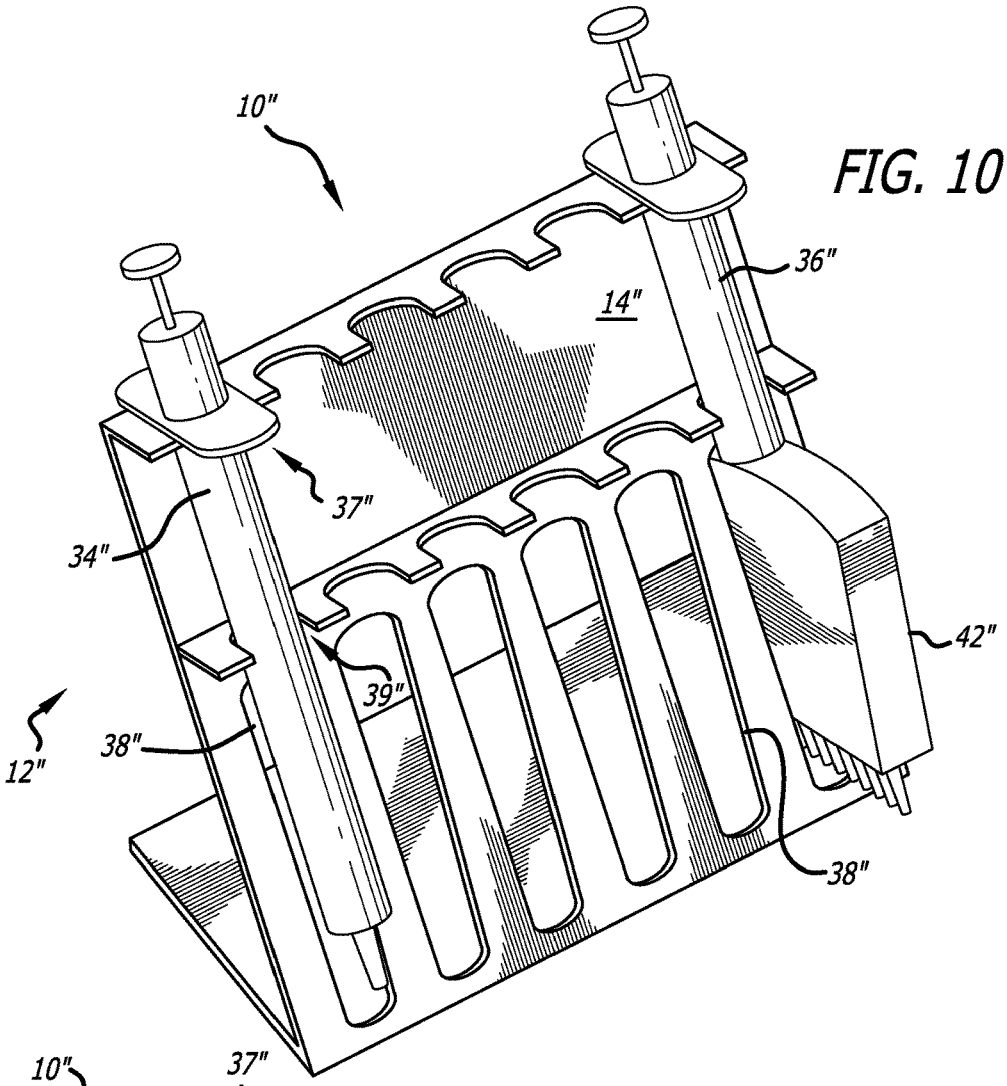
FIG. 10 is a left, front, top perspective view of a further embodiment of the laboratory pipette stand shown with a single channel pipette held therein and a multi-channel pipette with manifold received therein an elongated opening in which there is an elongated opening for each pipette position in accordance with the present disclosure.
Figure 11:
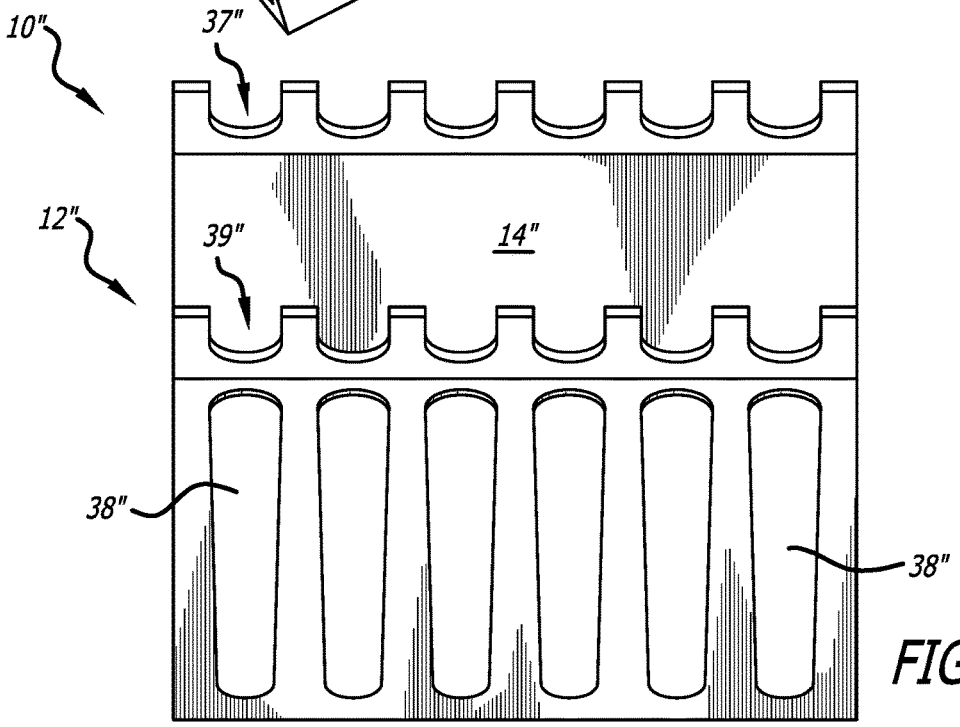
FIG. 11 is a front elevation view of the laboratory pipette stand of FIG. 10 in accordance with an example embodiment of the present disclosure.

As shown in FIGS. 10 and 11, the plurality of concave sections 22",30" of the first and second tiers 18",26" of the laboratory pipette stand 10" form a plurality of pipette positions 37",39" in which the single channel and multi-channel pipettes 34",36" are secured therein. In this embodiment, one elongated opening 38" is positioned thereunder each pipette position 37",39" along the angular longitudinal planar body 14" of the unitary structure 12". It is to be understood that the laboratory pipette stand 10" is not limited to the number of elongated openings 38" corresponding to the pipette positions 37",39" represented in the figures disclosed herein. The laboratory pipette stand 10" is not limited to any particular size or dimension and is suitably sized depending on the number of elongated openings 38" and pipette positions 37",39" formed therein.

It is to be understood that the laboratory pipette stand 10, 10',10" can be fabricated of at least one of plastic, acrylonitrile butadiene styrene (ABS), acrylic, polypropylene, polycarbonate, polystyrene, thermoplastic polymers, sheet metal, aluminum, stainless steel or any suitable sturdy material. It is presently contemplated that extra thickness is used throughout the entire structure to reinforce and replace the strength that is taken away when the elongated holes are cut out of the angular longitudinal planar body support surface.

In accordance with the present disclosure, the laboratory pipette stand 10, 10',10" can be manufactured via machine cutting, thermoforming, sonic welding, gluing or any suitable manufacturing process. For example, in one embodiment, sheet material (e.g., plastic) is cut to size on a CNC (computer numerical control) machine, the notches of the first tier are cut, and one or more openings are cut out in the angular support surface (unitary structure). The resulting flat pieces are thermoformed and shaped on a heated plastic bending table. The lower or second tier is then sonically welded or glued to the angular support surface.

These and other advantages of the present disclosure will be apparent to those skilled in the art. Accordingly, it will be recognized by those skilled in the art that changes or modifications may be made to the above-described embodiments without departing from the broad inventive concepts of the present disclosure. It should therefore be understood that the present disclosure is not limited to the particular embodiments described herein, but is intended to include all changes and modifications that are within the scope and spirit of the disclosure as encompassed by the disclosure and figures herein and the following claims.

What is claimed is:

1. A laboratory pipette stand, comprising; a unitary structure having an angular longitudinal planar body and a supporting base portion; a first tier of a plurality of outwardly projecting pronged sections having a first plurality of concave sections therebetween formed at an upper portion of the unitary structure, and a second tier of a plurality of outwardly projecting pronged sections having a second plurality of concave sections therebetween formed at a middle portion of the unitary structure, wherein the first plurality of concave sections and the second plurality of concave sections are configured to hold a plurality of single channel and multi-channel laboratory pipettes thereto; and at least one elongated opening formed in the angular longitudinal planar body and extending from the middle portion to a lower portion of the unitary structure, wherein the at least one elongated opening extends completely through the angular longitudinal planar body and is configured to receive a manifold of a multi-channel laboratory pipette therethrough.

2. The laboratory pipette stand of claim 1, wherein the unitary structure is a zigzag shape.

3. The laboratory pipette stand of claim 1, wherein the first plurality of concave sections and the second plurality of concave sections are U-shaped channels.

4. The laboratory pipette stand of claim 1, wherein the at least one elongated opening gradually tapers inward from a proximal end to a distal end thereof.

5. The laboratory pipette stand of claim 1, wherein the first plurality of concave sections and the second plurality of concave sections form a plurality of pipette positions in which the plurality of single channel and multi-channel laboratory pipettes are secured therein.

6. The laboratory pipette stand of claim 5, wherein the at least one elongated opening is positioned thereunder each pipette position along the angular longitudinal planar body of the unitary structure.

7. The laboratory pipette stand of claim 5, wherein the at least one elongated opening is positioned thereunder the plurality of pipette positions thereacross the angular longitudinal planar body of the unitary structure.

8. The laboratory pipette stand of claim 1, wherein the laboratory pipette stand is fabricated of at least one of, acrylonitrile butadiene styrene (ABS), acrylic, polypropylene, polycarbonate, polystyrene, thermoplastic polymers, sheet metal, aluminum, and stainless steel.

9. The laboratory pipette stand of claim 1, wherein the laboratory pipette stand is manufactured via machine cutting, thermoforming, sonic welding or gluing.

10. The laboratory pipette stand of claim 1, wherein the laboratory pipette stand is fabricated of plastic.

11. A laboratory pipette stand, comprising:

a unitary structure having an angular longitudinal planar body and a supporting base portion;

a first tier of a plurality of outwardly projecting pronged sections having a first plurality of concave sections therebetween formed at an upper portion of the unitary structure, and a second tier of a plurality of outwardly projecting pronged sections having a second plurality of concave sections therebetween formed at a middle portion of the unitary structure, wherein the first plurality of concave sections and the second plurality of concave sections are configured for holding a plurality of single channel and multi-channel laboratory pipettes thereto; and a series of elongated openings formed in the angular longitudinal planar body and extending from the middle portion to a lower portion of the unitary structure, wherein the series of elongated openings extend completely through the angular longitudinal planar body and are configured to receive manifolds of a plurality of multi-channel laboratory pipettes therethrough.

12. The laboratory pipette stand of claim 11, wherein the series of elongated openings include two or four openings formed therein the angular longitudinal planar body of the unitary structure.

13. The laboratory pipette stand of claim 11, wherein the series of elongated openings gradually taper inward from a proximal end to a distal end thereof.

14. The laboratory pipette stand of claim 11, wherein the series of elongated openings are sized and shaped to receive the manifolds of the plurality of multi-channel laboratory pipettes therethrough.

* * * * *